US011074861B2

(12) United States Patent
Park et al.

(10) Patent No.: US 11,074,861 B2
(45) Date of Patent: Jul. 27, 2021

(54) GATE DRIVER, ORGANIC LIGHT EMITTING DIODE DISPLAY DEVICE, AND METHOD OF DRIVING THE SAME

(71) Applicant: LG Display Co., Ltd., Seoul (KR)

(72) Inventors: Ji-Woong Park, Goyang-si (KR); Seung-Ju Jo, Gwangju (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/700,697

(22) Filed: Dec. 2, 2019

(65) Prior Publication Data

US 2020/0193903 A1 Jun. 18, 2020

(30) Foreign Application Priority Data

Dec. 14, 2018 (KR) ..... 10-2018-0161539

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2310/0289* (2013.01); *G09G 2310/08* (2013.01); *G09G 2320/0247* (2013.01); *G09G 2330/02* (2013.01)

(58) Field of Classification Search
CPC ..... G09G 3/3233
See application file for complete search history.

(56) References Cited

U.S. PATENT DOCUMENTS

2017/0345358 A1* 11/2017 Xu ..... G09G 3/2022
2018/0061312 A1* 3/2018 He ..... H01L 27/3255

* cited by examiner

*Primary Examiner* — Gustavo Polo
(74) *Attorney, Agent, or Firm* — Birch, Stewart, Kolasch & Birch, LLP

(57) ABSTRACT

A gate driver, an organic light emitting diode display device and a method of driving the same, which are capable of preventing a driving transistor from affecting a light emitting diode when power is applied and when impedance is measured, are discussed. The organic light emitting diode display device can include a driving transistor connected to one end of an organic light emitting diode to supply operating current to the organic light emitting diode, an emission switching transistor switched according to an emission control signal to control flow of current supplied from the driving transistor to the organic light emitting diode, and a timing controller configured to perform control to maintain the emission switching transistor in an off state such that the driving transistor does not affect the organic light emitting diode until an internal terminal of a pixel of a display panel is stabilized when power is applied.

14 Claims, 7 Drawing Sheets

GATE DRIVER, ORGANIC LIGHT EMITTING DIODE DISPLAY DEVICE, AND METHOD OF DRIVING THE SAME

CROSS-REFERENCE TO RELATED APPLICATION

This application claims the priority benefit of Korean Patent Application No. 10-2018-0161539, filed on Dec. 14, 2018 in the Republic of Korea, which is hereby incorporated by reference as if fully set forth herein into the present application.

BACKGROUND OF THE INVENTION

Field of the Invention

The present invention relates to an organic light emitting diode display device, and more particularly, to an organic light emitting diode display device capable of preventing a driving transistor from affecting a light emitting diode when power is applied and when impedance is measured.

Discussion of the Related Art

Recently, development of various flat panel displays (FPDs) has been accelerated. Particularly, an organic light emitting diode display device uses a self-luminous element for emitting light by itself and thus has a high response speed, a high luminous efficiency, a high luminance and a wide viewing angle.

The organic light emitting diode display device generally has an organic light emitting diode for each pixel. The organic light emitting diode includes an organic compound layer formed between an anode electrode and a cathode electrode. The organic compound layer includes a hole injection layer (HIL), a hole transport layer (HTL), an emission layer (EML), an electron transport layer (ETL) and an electron injection layer (EIL). When a driving voltage is applied to the anode electrode and the cathode electrode, holes passing through the hole transport layer (HTL) and electrons passing through the electron transport layer (ETL) are moved to the emission layer (EML) to form excitons and, as a result, the emission layer (EML) generates visible light.

In the organic light emitting diode display device, pixels each including the organic light emitting diode are arranged in a matrix and the brightness of the pixels is controlled by gray scales of video data. In the organic light emitting diode display device, thin film transistors (TFTs) as active elements are selectively turned on to select pixels and the emission of the pixels is maintained by a voltage stored in a storage capacitor.

While the impedance of the organic light emitting diode for compensating for the threshold voltage of the driving transistor of the organic light emitting diode display device is measured, current leakage may occur in a region other than a sensing path to cause a measurement error or an unintended current path may be formed in the organic light emitting diode in a display panel to cause image quality issues such as screen flickers when power is applied.

SUMMARY OF THE INVENTION

Accordingly, the present invention is directed to a gate driver, an organic light emitting diode display device using the same, and a method of driving the same that substantially obviate one or more problems due to limitations and disadvantages of the related art.

An object of the present invention is to provide an organic light emitting diode display device capable of preventing a driving transistor from affecting a light emitting diode when power is applied and when impedance is measured.

Another object of the present invention is to provide an organic light emitting diode display device capable of blocking a path of current flowing in an organic light emitting diode when power is applied and when impedance is measured.

Another object of the present invention is to provide an organic light emitting diode display device capable of preventing screen flickers unintended by a user due to an abnormal voltage formed in an organic light emitting diode when power is applied.

A further object of the present invention is to provide an organic light emitting diode display device capable of preventing performance of a product from deteriorating by preventing abnormal operation when power is applied.

Additional advantages, objects, and features of the invention will be set forth in part in the description which follows and in part will become apparent to those having ordinary skill in the art upon examination of the following or can be learned from practice of the invention. The objectives and other advantages of the invention can be realized and attained by the structure particularly pointed out in the written description and claims hereof as well as the appended drawings.

To achieve these objects and other advantages and in accordance with the purpose of the invention, as embodied and broadly described herein, an organic light emitting diode display device includes a driving transistor connected to one end of an organic light emitting diode to supply operating current to the organic light emitting diode, an emission switching transistor switched according to an emission control signal to control flow of current supplied from the driving transistor to the organic light emitting diode, and a timing controller configured to perform control to maintain the emission switching transistor in an off state such that the driving transistor does not affect the organic light emitting diode until an internal terminal of a pixel of a display panel is stabilized when power is applied.

The organic light emitting diode display device according to an example of the present invention can further include a level shifter configured to receive a control signal from the timing controller and to supply an operating voltage to an emission control driver.

In the organic light emitting diode display device according to an example of the present invention, the timing controller can output a control signal for changing a reference voltage of the emission control driver when power is applied.

In another aspect of the present invention, an organic light emitting diode display device includes a driving transistor connected to one end of an organic light emitting diode to supply operating current to the organic light emitting diode, an emission switching transistor switched according to an emission control signal to control flow of current supplied from the driving transistor to the organic light emitting diode, and a timing controller configured to perform control to maintain the emission switching transistor in an off state such that the driving transistor does not affect the organic light emitting diode until an internal terminal of a pixel of a display panel is stabilized when impedance of the organic light emitting diode is measured.

In another aspect of the present invention, a gate driver comprises a first scan driver configured to supply a first scan signal for transmitting a data voltage to a gate electrode of a driving transistor for supplying operating current to an organic light emitting diode; a second scan driver configured to supply a second scan signal for transmitting a voltage stored in a storage capacitor connected to the gate electrode of the driving transistor to a drain electrode of the driving transistor; and an emission control driver configured to output an emission control signal for controlling flow of current supplied from the driving transistor to the organic light emitting diode, such that the driving transistor does not affect the organic light emitting diode when impedance of the organic light emitting diode is measured.

In another aspect of the present invention, a gate driver comprises a first scan driver configured to supply a first scan signal for transmitting a data voltage to a gate electrode of a driving transistor for supplying operating current to an organic light emitting diode; a second scan driver configured to supply a second scan signal for transmitting a voltage stored in a storage capacitor connected to the gate electrode of the driving transistor to a drain electrode of the driving transistor; and an emission control driver configured to output an emission control signal for controlling flow of current supplied from the driving transistor to the organic light emitting diode, such that the driving transistor does not affect the organic light emitting diode when power is applied.

In another aspect of the present invention, a method of driving an organic light emitting diode display device comprises determining by a timing controller a predetermined driving condition; generating by the timing controller a control signal for blocking current supplied from a driving transistor to an organic light emitting diode such that the driving transistor does not affect the organic light emitting diode until an internal terminal of a pixel of a display panel is stabilized; supplying by the timing controller the control signal to an emission control driver; and performing control by the emission control driver such that an emission switching transistor disposed between the driving transistor and the organic light emitting diode is turned off.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Figure 1:
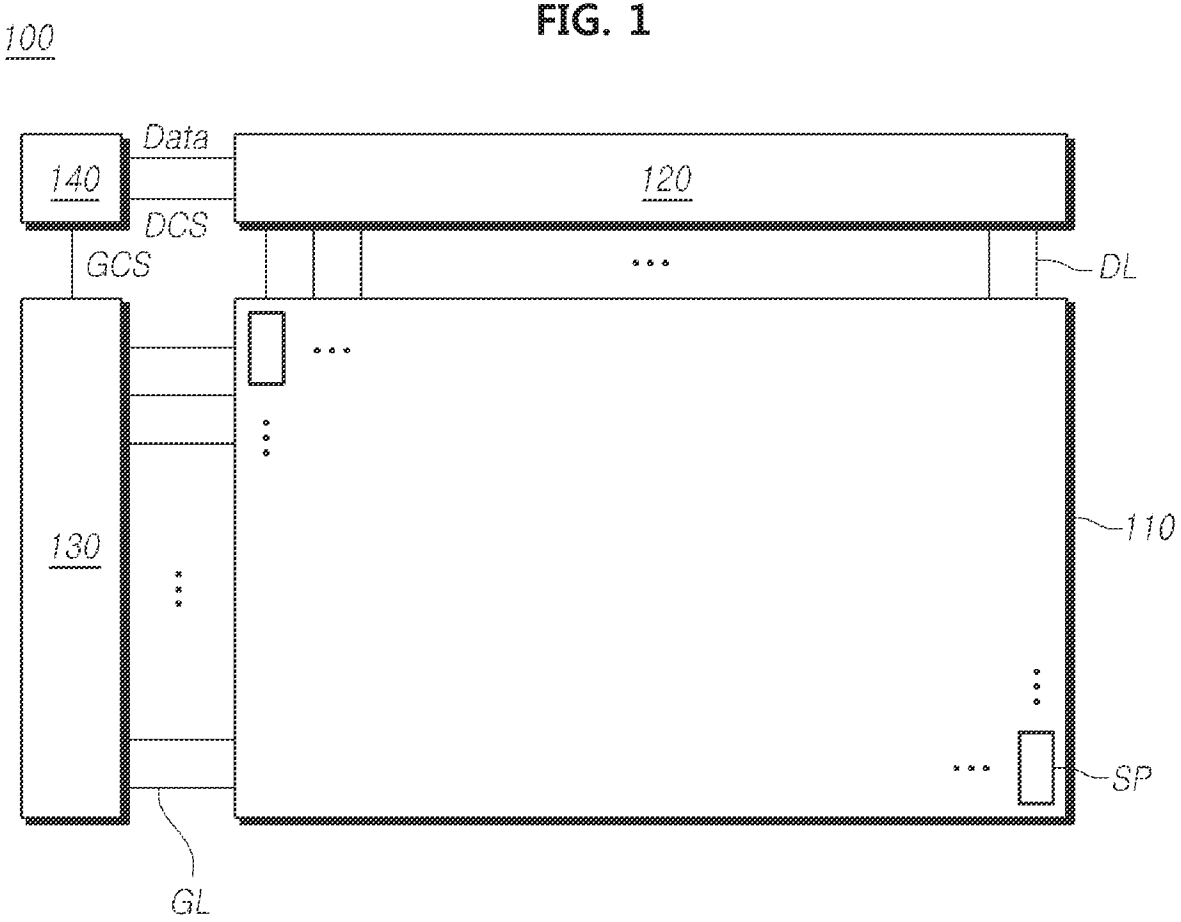
FIG. 1 is a view showing the pixel structure of an organic light emitting diode display device according to an embodiment of the present invention.

Specific structures or functions are described for the purpose of explaining the embodiments of the present invention and the embodiments of the present invention can be implemented in a variety of forms and should not be limited to the embodiments disclosed herein.

Since the present invention can be variously modified and have several exemplary embodiments, specific exemplary embodiments will be shown in the accompanying drawings and described in detail. However, it is to be understood that the present invention is not limited to the specific exemplary embodiments, but includes all modifications, equivalents, and substitutions included within the spirit and the scope of the present invention.

Terms such as 'first', 'second', etc., can be used to describe various components, but the components are not to be construed as being limited by the terms. The terms are used only to distinguish one component from another component. For example, the 'first' component can be named the 'second' component and the 'second' component can also be similarly named the 'first' component, without departing from the scope of the present invention.

It is to be understood that when one element is referred to as being "connected to" or "coupled to" another element, it can be connected directly to or coupled directly to another element or be connected to or coupled to another element, having the other element intervening therebetween. On the other hand, it is to be understood that when one element is referred to as being "connected directly to" or "coupled directly to" another element, it is connected to or coupled to another element without the other element intervening therebetween. Other expressions describing a relationship between components, that is, "between," "directly between," "neighboring," "directly neighboring" and the like, should be similarly interpreted.

Terms used in the present specification are used only in order to describe specific exemplary embodiments rather than limiting the present invention. Singular forms used herein are intended to include plural forms unless explicitly indicated otherwise. It will be further understood that the terms "comprises" or "have" used in this specification, specify the presence of stated features, steps, operations, components, parts, or a combination thereof, but do not preclude the presence or addition of one or more other features, steps, operations, components, parts, or combinations thereof.

Unless indicated otherwise, it is to be understood that all the terms used in the specification including technical and scientific terms have the same meaning as understood by those skilled in the art. It must be understood that the terms defined by the dictionary are identical with the meanings within the context of the related art, and they should not be ideally or excessively formally defined unless context clearly dictates otherwise.

On the other hand, if an embodiment is otherwise implemented, the functions or operations specified in particular blocks can be performed in an order different from the order specified in the flowchart. For example, two consecutive blocks can actually be performed substantially concurrently, and the blocks can be performed backwards depending on the associated function or operation.

Hereinafter, exemplary embodiments of the present invention will be described in detail with reference to the accompanying drawings.

FIG. 1 is a view showing the pixel structure of an organic light emitting diode display device 100 according to the present embodiment. All components of the organic light emitting diode display device according to all embodiments of the present invention are operatively coupled and configured.

Referring to FIG. 1, the organic light emitting diode display device 100 according to the present embodiment can include an organic light emitting display panel 110 on which a plurality of data lines DL and a plurality of gate lines GL are disposed and a plurality of sub pixels SP defined by the plurality of data lines DL and the plurality of gate lines GL is arranged, a data driver 120 for driving the plurality of data lines DL and a gate driver 130 for driving the plurality of gate lines GL.

In addition, the organic light emitting diode display device 100 according to the present embodiment can further include a timing controller 140 for controlling the data driver 120 and the gate driver 130.

The timing controller 140 can supply various types of control signals to the data driver 120 and the gate driver 130 to control the data driver 120 and the gate driver 130.

The timing controller 140 starts scan according to timing implemented in each frame, converts input image data received from the outside to suit a data signal used in the data driver 120, outputs the converted image data, and controls data driving at a suitable time according to scan.

The timing controller 140 can be a timing controller used in general display technology or a control device including the timing controller to perform other control functions.

The timing controller 140 can be implemented independently of the data driver 120 or can be implemented integrally with the data driver 120.

The data driver 120 supplies a data voltage to the plurality of data lines DL, thereby driving the plurality of data lines DL. Here, the data driver 120 is also referred to as a source driver.

The data driver 120 can include at least one source driver integrated circuit (SDIC).

Each source driver integrated circuit (SDIC) can include a shift register, a latch circuit, a digital-to-analog converter (DAC) and an output buffer.

In some cases, each source driver integrated circuit (SDIC) can further include an analog-to-digital converter (ADC).

The gate driver 130 sequentially supplies a scan signal to the plurality of gate lines GL, thereby sequentially driving the plurality of gate lines GL. Here, the gate driver 130 is also referred to as a scan driver.

The gate driver 130 can include at least one gate driver integrated circuit (GDIC).

Each gate driver integrated circuit (GDIC) can include a shift register and a level shifter, for example.

The gate driver 130 sequentially supplies the scan signal of an On voltage or an Off voltage to the plurality of gate lines GL, under control of the timing controller 140.

The data driver 120 converts the image data. Data received from the timing controller 140 into an analog data voltage and supplies the analog data voltage to the plurality of data lines DL, when a specific gate line is opened by the gate driver 130.

As shown in FIG. 1, the data driver 120 can be located only at one side (e.g., an upper side, a lower side, a left side or a right side) of the organic light emitting display panel 110. In some cases, the data driver 120 can be located at both sides (e.g., an upper side and a lower side or a left side and a right side) of the organic light emitting display panel 110 according to a driving method, a panel designing method, etc.

As shown in FIG. 1, the gate driver 130 can be located only at one side (e.g., a left side, a right side, an upper side or a lower side) of the organic light emitting display panel 110. In some cases, the gate driver 130 can be located at both sides (e.g., a left side and a right side or an upper side and a lower side) of the organic light emitting display panel 110 according to a driving method, a panel designing method, etc.

The timing controller 140 receives various types of timing signals including a vertical synchronization signal (Vsync), a horizontal synchronization signal (Hsync), an input data enable (DE) signal and a clock signal (CLK) from the outside (e.g., a host system).

The timing controller 140 receives the timing signals such as the vertical synchronization signal (Vsync), the horizontal synchronization signal (Hsync), the input DE signal and the clock signal and generates and outputs various types of control signals to the data driver 120 and the gate driver 130, in order to control the data driver 120 and the gate driver 130.

For example, the timing controller 140 outputs various types of gate control signals GCS including a gate start pulse (GSP), a gate shift clock (GSC), a gate output enable signal (GOE), in order to control the gate driver 130.

Here, the gate start pulse (GSP) controls operation start timing of one or more gate driver integrated circuits configuring the gate driver 130. The gate shift clock (GSC) is a clock signal commonly input to one or more gate driver integrated circuits and controls the shift timing of the scan signal (gate pulse). The gate output enable signal (GOE) designates timing information of one or more gate driver integrated circuits.

In addition, the timing controller 140 outputs various types of data control signals DCS including a source start pulse (SSP), a source sampling clock (SSC) and a source output enable signal (SOE), in order to control the data driver 120.

Here, the source start pulse SSP controls data sampling start timing of one or more source driver integrated circuits configuring the data driver 120. The source sampling clock (SSC) is a clock signal for controlling the sampling timing of data in each source driver integrated circuit. The source output enable signal (SOE) controls the output timing of the data driver 120.

Each sub pixel SP arranged on the organic light emitting display panel 110 includes circuit elements such as an organic light emitting diode (OLED) which is a self-luminous element and a driving transistor for driving an organic light emitting diode (OLED).

The type and number of circuit elements configuring each sub pixel SP can be variously determined according to the provided function and the design method.

Figure 2:
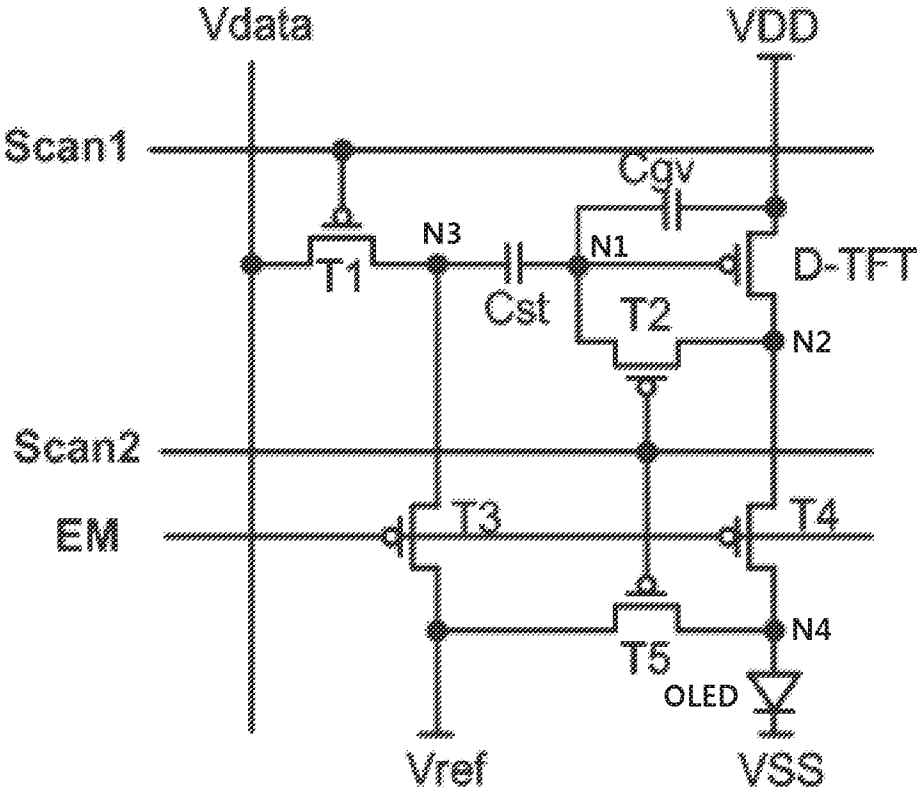
FIG. 2 is a view showing the circuit structure of a sub pixel of the organic light emitting diode display device according to an example of the present invention.

FIG. 2 is a view showing the circuit structure of a sub pixel of the organic light emitting diode display device according to an example of the present invention. For compensation for the threshold voltage of the driving TFT, as shown in FIG. 3, a pixel operation is performed in three periods (Step 1, Step 2 and Step 3).

Figure 3:
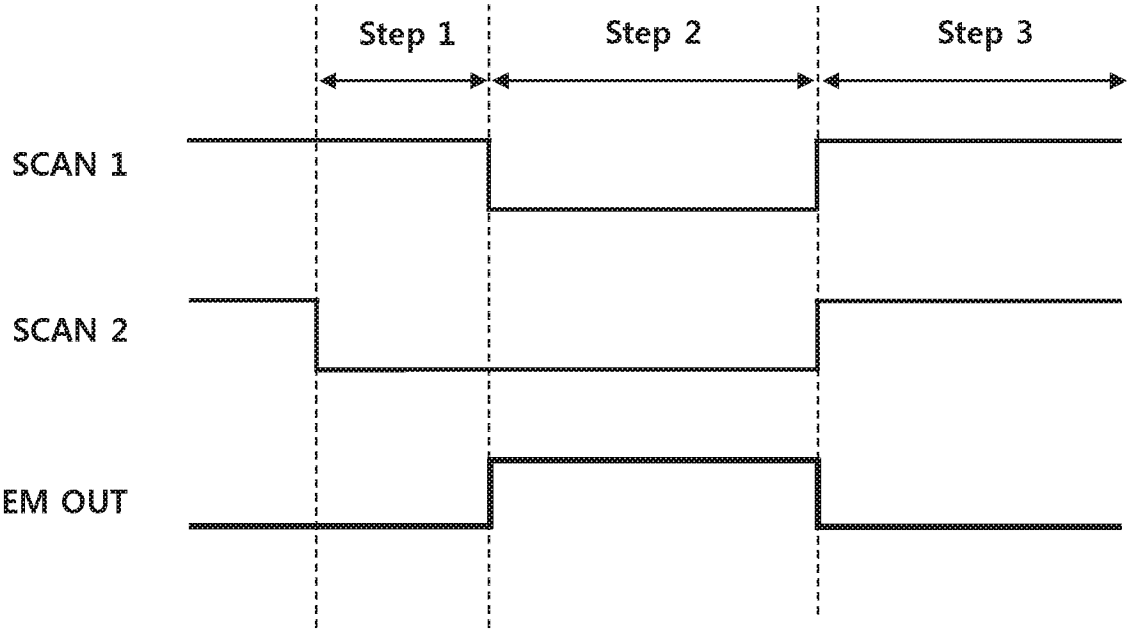
FIG. 3 is a waveform diagram showing a signal applied to a pixel in order to compensate for a threshold voltage of a driving transistor.

Referring to FIGS. 2 and 3, each sub pixel SP includes a driving transistor D-TFT, first to fifth TFTs T1 to T5, a storage capacitor Cst and an organic light emitting diode OLED. The first to fifth TFTs T1 to T5 and the driving TFT D-TFT are implemented by p-type metal oxide semiconductor thin film transistor (MOSTFT). Although the p-type MOSTFT is described in the present embodiment, an n-type MOSTFT can be used and a description of change in configuration will be omitted.

The driving TFT D-TFT supplies driving current from an input terminal of a high-potential driving voltage VDD to the organic light emitting diode OLED and controls the driving current through a gate-source voltage. The gate electrode (control electrode) of the driving transistor D-TFT is connected to a first node N1. The source electrode (first electrode) of the driving transistor D-TFT is connected to an input terminal of the high-potential driving voltage VDD and the drain electrode (second electrode) thereof is connected to a second node N2.

The first TFT T1 switches a current path between the data line and the third node N3 in response to a first scan pulse Scant. The first TFT T1 is turned on during the second period (Step 2) to supply a data voltage Vdata to a third node N3. The gate electrode of the first TFT T1 is connected to the first gate line. The source electrode of the first TFT T1 is connected to the data line and the drain electrode thereof is connected to the third node N3.

The second TFT T2 switches a current path between the first node N1 and the second node N2 in response to a second scan pulse Scan2. The second TFT T2 is a sampling TFT and is turned on during the second period (Step 2) to diode-connect the driving transistor D-TFT, such that the threshold voltage of the driving transistor D-TFT is applied to the first node N1. The gate electrode of the second TFT T2 is connected to the second gate line. The source electrode of the second TFT T2 is connected to the first node N1 and the drain electrode thereof is connected to the second node N2.

The third TFT T3 switches a current path between the third node N3 and an input terminal of a reference voltage Vref in response to an emission control pulse EM. The third TFT T3 is turned on the first and third period (Step 1 and Step 3) to apply a reference voltage Vref to the third node N3. The gate electrode of the third TFT T3 is connected to an emission control signal line so as to supply the reference voltage Vref to the third node in response to the emission control pulse EM. The source electrode of the third TFT T3 is connected to the input terminal of the reference voltage Vref and the drain electrode thereof is connected to the third node N3.

The fourth TFT T4 switches a current path between the second node N2 and a fourth node N4 in response to the emission control pulse EM. The fourth TFT T4 is turned on during the first and third periods (Step 1 and Step 3) to form a current path between the driving transistor D-TFT and the organic light emitting diode OLED and is turned off during the second period (Step 2) to block the current path between the driving transistor D-TFT and the organic light emitting diode OLED. The gate electrode of the fourth TFT T4 is connected to the emission control signal line, the source electrode of the fourth TFT T4 is connected to the second node N2 and the drain electrode thereof is connected to the fourth node N4.

The fifth TFT T5 switches a current path between the input terminal of the reference voltage Vref and the fourth node N4 in response to a second scan pulse Scan2. The fifth TFT T5 is turned on during the first and second periods (Step 1 and Step 2) to apply the reference voltage Vref to the fourth node N4.

The gate electrode of the fifth TFT T5 is connected to the second gate line. The source electrode of the fifth TFT T5 is connected to the fourth node N4 and the drain electrode thereof is connected to the input terminal of the reference voltage Vref.

The storage capacitor Cst is connected between the first node N1 and the third node N3 to maintain the gate voltage of the driving transistor D-TFT.

Such an organic light emitting diode display device compensates for change in the threshold voltage of the driving TFT D-TFT through a voltage compensation driving method. In the organic light emitting diode display device for voltage compensation, after the storage capacitor is connected to the gate of the driving TFT D-TFT and the sampling TFT T2 is connected between the gate and the drain of the driving TFT D-TFT, the sampling TFT T2 is turned on to diode-connect the driving TFT D-TFT, thereby storing the threshold voltage ($V_{th}$) of the driving TFT D-TFT in the storage capacitor Cst.

In order to compensate for the threshold voltage of the driving TFT D-TFT, the pixel operation is performed in three steps as shown in FIG. 3. In Step 1, the first transistor T1 is in a turn-off state because the first scan signal Scant is output as a high signal, the sampling transistor T2 and the fifth transistor T5 are in a turn-on state because the second scan signal Scan2 is output as a low signal, and the fourth transistor disposed between the drain terminal of the driving transistor D-TFT and the anode of the organic light emitting diode is in a turn-on state because the emission control signal EM is output as a low signal.

Figure 4:
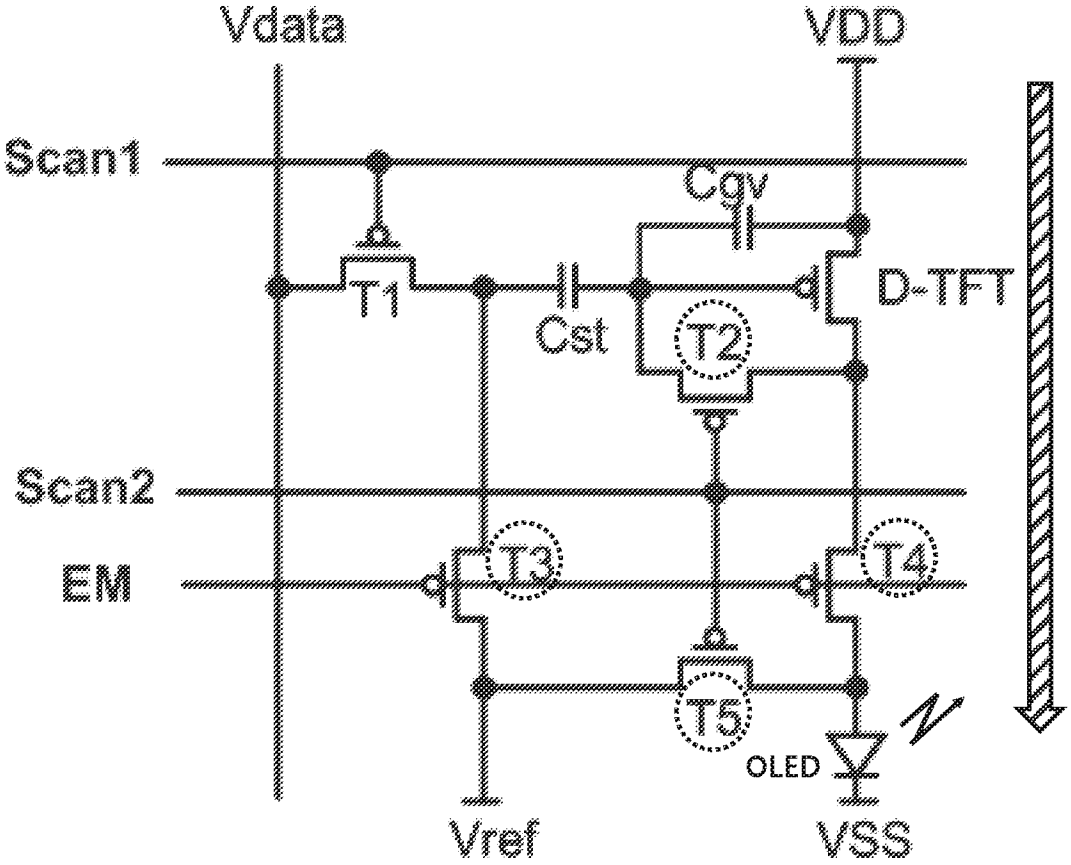
FIG. 4 is a view showing a current path instantaneously formed between VDD and VSS.

Accordingly, since the second transistor T2 which is the sampling transistor is in the turn-on state during Step 1, the gate and the source of the driving transistor D-TFT are connected, thereby causing a diode connection. By such operation, as shown in FIG. 4, a current path in which two diodes are connected from VDD to VSS is instantaneously formed, such that the organic light emitting diode instantaneously emits light. At this time, the organic light emitting diode emits light unintended by the user, thereby causing image quality issues such as screen flickers. Even when power is applied (power ON), since the emission control signal is output as a low signal, a screen flicker phenomenon can occur due to an unintended current path and thus an image quality issue occurs.

Figure 5:
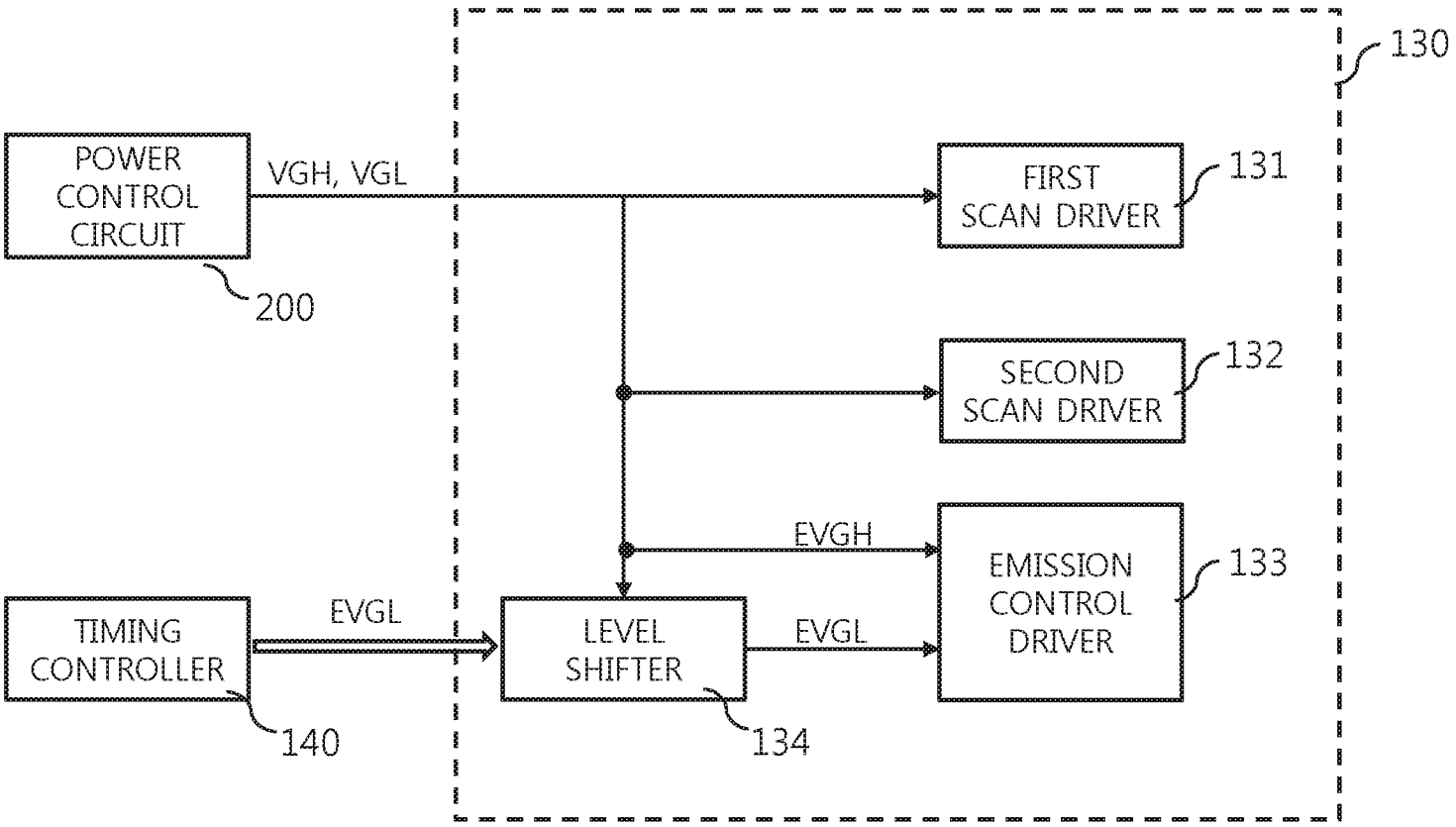
FIG. 5 is a schematic block diagram showing a configuration for supplying power of an organic light emitting diode display device according to an embodiment of the present invention for solving a problem.

FIG. 5 is a schematic block diagram showing a configuration for supplying power of an organic light emitting diode display device according to an embodiment of the present invention for solving such a limitation.

As shown in FIG. 5, a power control circuit 200, a gate driver 130 and a timing controller 140 are included in the organic light emitting diode display device. The gate driver 130 includes a first scan driver 131 for supplying the first scan signal Scant to the first transistor T1 of FIG. 2, a second scan driver 132 for supplying the second scan signal Scan2 to the second and fifth transistors T2 and T5 of FIG. 2, an emission control driver 133 for supplying the emission control signal EM to the third and fourth transistors T3 and T4 of FIG. 2, and a level shifter 134 for receiving a high voltage signal VGH and a low voltage signal VGL from the power control circuit 200, amplifying the voltage levels thereof and supplying operation power EVGH and EVGL to the emission control driver 133.

At this time, the level shifter 134 receives a voltage level control signal from the timing controller 140. The level shifter 134 receives a control signal from the timing controller 140 and supplies an operating voltage to the emission control driver 133. The voltage level control signal changes the reference voltage of the emission control driver 133 such that the emission control driver 133 outputs a logic high signal. Accordingly, the fourth TFT T4 which is the emission switching transistor in the pixel circuit switches a current path between the second node N2 and the fourth node N4 in response to the emission control pulse EM.

Figure 6:
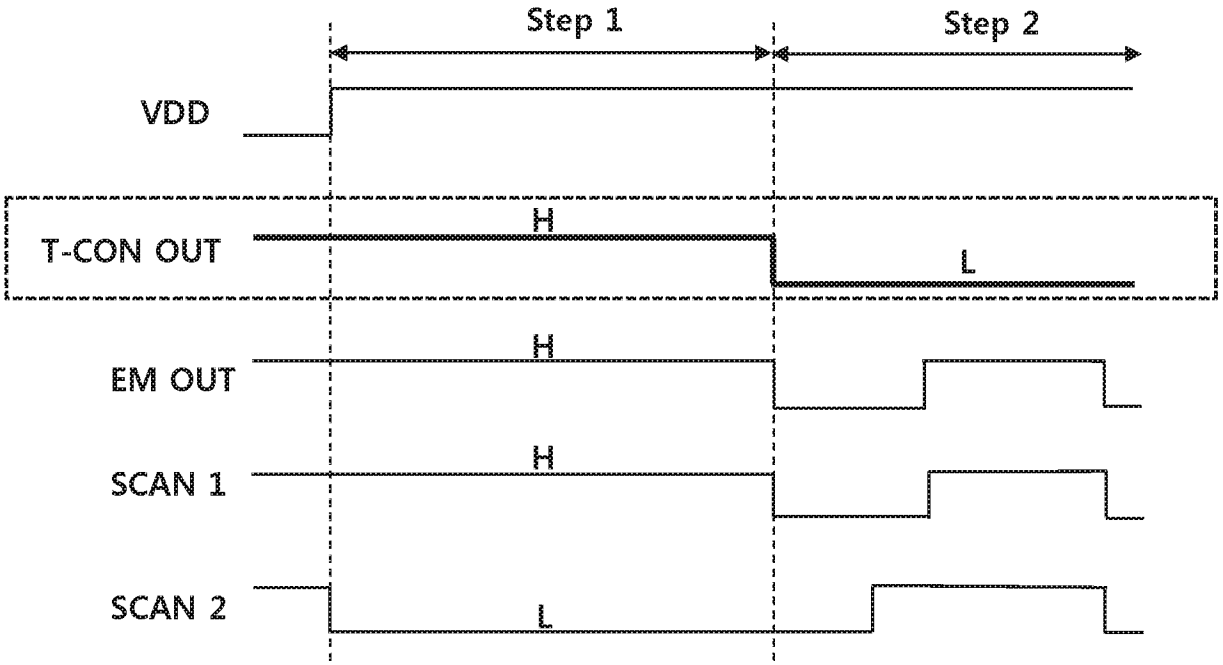
FIG. 6 is a timing waveform diagram of a voltage level applied to a driving transistor D-TFT in a pixel, an output signal of a timing controller, an emission control signal and first and second scan signals according to an example of the present invention.

At this time, the voltage level VDD supplied to the driving transistor D-TFT in the pixel, the output signal T-CON OUT of the timing controller 140, the emission control signal or pulse EM OUT and the first and second scan signals Scan1 and Scan2 appear as shown in the timing waveform diagram of FIG. 6.

Figure 7:
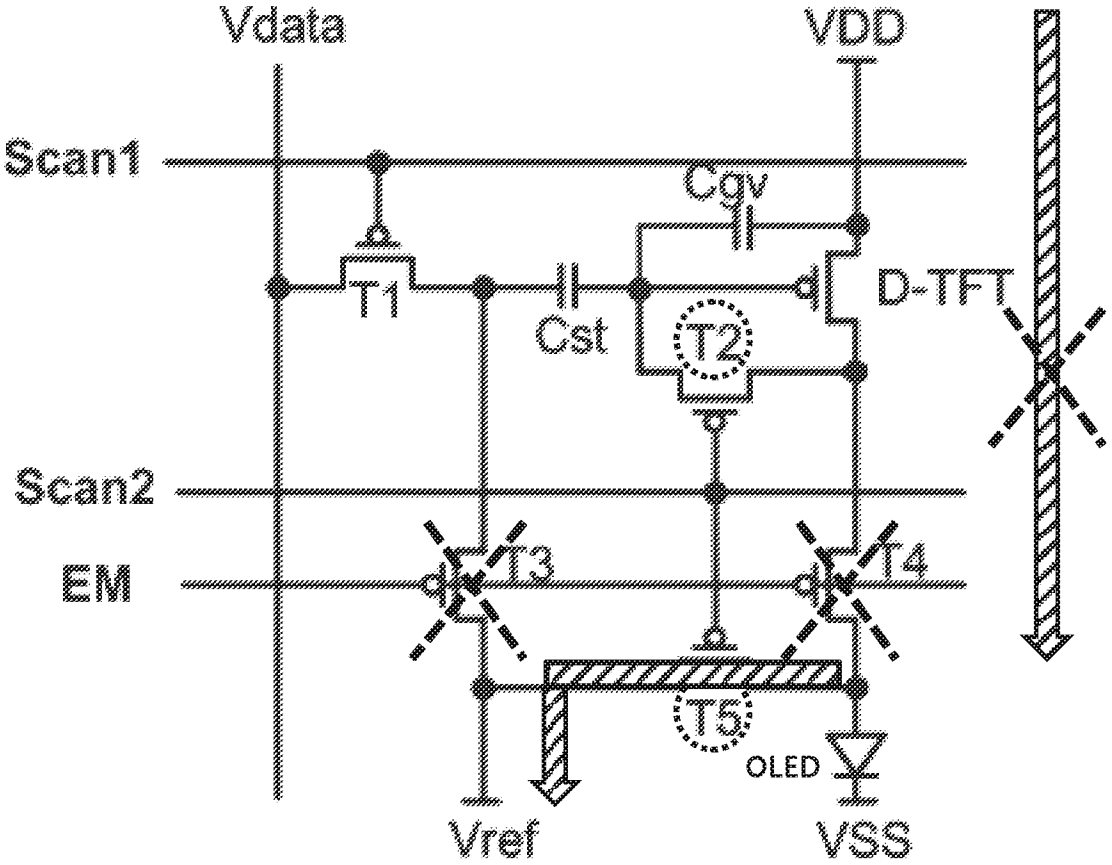
FIG. 7 is a view showing the operation state of a pixel circuit in a first period (Step 1) of FIG. 6.

At this time, the first period (Step 1) indicates a time until the internal terminal of the pixel of the display panel is stabilized when power is applied and a time for impedance measurement, and Step 2 preferably means a display period. As shown in FIG. 6, in Step 1, the output signal T-CON OUT of the timing controller 140, the output signal EM OUT of the emission control driver and the first scan signal Scan1 indicate a logic high and the second scan signal Scan2 indicates a logic low. Therefore, in the pixel circuit, as shown in FIG. 7, the second and fifth transistors T2 and T5 are turned on and the third and fourth transistors T3 and T4 are turned off, by the second scan signal SCAN2 indicating the logic low. Accordingly, during the first period T1 indicating the time when power is applied and the time when impedance is measured, the current path from the driving transistor D-TFT to the organic light emitting diode OLED is blocked. That is, the emission control switching transistor T4 is switched according to the emission control signal EM OUT, thereby controlling flow of current from the driving transistor D-TFT to the organic light emitting diode OLED.

The impedance of the organic light emitting diode is transmitted to the data driver through a sensing path connected to a reference voltage supply line by the fifth transistor T5 turned on by the second scan signal SCAN2.

As described above, the organic light emitting diode display device according to the embodiments of the present invention can prevent or minimize screen flickers unintended by the user from occurring by the current path from the driving transistor to the organic light emitting diode when power is applied and when impedance is measured.

The organic light emitting diode display device according to one or more embodiments of the present invention can have various advantages and effects including the following effects and advantages.

First, it is possible to prevent a screen flicker phenomenon from occurring when power is applied.

Second, it is possible to prevent a screen flicker phenomenon from occurring when impedance is measured.

Third, it is possible to prevent screen flicker unintended by a user.

Although the invention has been described with reference to the exemplary embodiments, those skilled in the art will appreciate that various modifications and variations can be made in the present invention without departing from the spirit or scope of the invention described in the appended claims.

What is claimed is:

1. An organic light emitting diode display device comprising:
   - a display panel including:
     - an organic light emitting diode,
     - a driving transistor connected to one end of the organic light emitting diode to supply operating current to the organic light emitting diode, and
     - an emission switching transistor being switched according to an emission control signal to control flow of current supplied from the driving transistor to the organic light emitting diode;
   - an emission control driver configured to output an emission control signal for controlling flow of current supplied from the driving transistor to the organic light emitting diode; and
   - a timing controller configured to perform control to maintain the emission switching transistor in an off state, so that the driving transistor does not affect the organic light emitting diode until an internal terminal of a pixel of the display panel is stabilized when power is applied,
   - wherein the timing controller outputs a control signal for changing a reference voltage of the emission control driver when power is applied.

2. The organic light emitting diode display device according to claim 1, further comprising:
   - a level shifter configured to receive the control signal from the timing controller, and supply an operating voltage to the emission control driver.

3. An organic light emitting diode display device comprising:
   - a driving transistor connected to one end of an organic light emitting diode to supply operating current to the organic light emitting diode;
   - an emission switching transistor being switched according to an emission control signal to control flow of current supplied from the driving transistor to the organic light emitting diode;
   - an emission control driver configured to output an emission control signal for controlling flow of current supplied from the driving transistor to the organic light emitting diode; and
   - a timing controller configured to perform control to maintain the emission switching transistor in an off state, so that the driving transistor does not affect the organic light emitting diode when an impedance of the organic light emitting diode is measured,
   - wherein the timing controller outputs a control signal for changing a reference voltage of the emission control driver when the impedance of the organic light emitting diode is measured.

4. The organic light emitting diode display device according to claim 3, further comprising:
   - a level shifter configured to receive the control signal from the timing controller, and supply an operating voltage to the emission control driver.

5. A gate driver comprising:
   - a first scan driver configured to supply a first scan signal for transmitting a data voltage to a gate electrode of a driving transistor for supplying operating current to an organic light emitting diode;
   - a second scan driver configured to supply a second scan signal for transmitting a voltage stored in a storage capacitor connected to the gate electrode of the driving transistor to a drain electrode of the driving transistor; and an emission control driver configured to output an emission control signal for controlling flow of current supplied from the driving transistor to the organic light emitting diode, so that the driving transistor does not affect the organic light emitting diode when an impedance of the organic light emitting diode is measured, wherein the emission control driver changes a voltage supplied from a power control circuit to output an emission control signal by a reference signal.

6. The gate driver according to claim 5, further comprising:

a level shifter configured to receive a high voltage signal and a low voltage signal from the power control circuit, amplify the voltage levels thereof, and supply operation power to the emission control driver.

7. A gate driver comprising:

a first scan driver configured to supply a first scan signal for transmitting a data voltage to a gate electrode of a driving transistor for supplying operating current to an organic light emitting diode;

a second scan driver configured to supply a second scan signal for transmitting a voltage stored in a storage capacitor connected to the gate electrode of the driving transistor to a drain electrode of the driving transistor; and an emission control driver configured to output an emission control signal for controlling flow of current supplied from the driving transistor to the organic light emitting diode, so that the driving transistor does not affect the organic light emitting diode when power is applied, wherein the emission control driver changes a voltage supplied from a power control circuit to output an emission control signal by a reference signal.

8. The gate driver according to claim 7, further comprising:

a level shifter configured to receive a high voltage signal and a low voltage signal from the power control circuit, amplify the voltage levels thereof, and supply operation power to the emission control driver.

9. A method of driving an organic light emitting diode display device, the organic light emitting diode display device including a timing controller, a driving transistor and an organic light emitting diode, the method comprising:

determining by the timing controller a predetermined driving condition;

generating by the timing controller a control signal for blocking current supplied from the driving transistor to the organic light emitting diode, so that the driving transistor does not affect the organic light emitting diode until an internal terminal of a pixel of a display panel of the organic light emitting diode display device is stabilized;

supplying by the timing controller the control signal to an emission control driver; and performing control by the emission control driver, so that an emission switching transistor disposed between the driving transistor and the organic light emitting diode is turned off, wherein the determining by the timing controller the predetermined driving condition is performed when power is applied to the organic light emitting diode display device.

10. A method of driving an organic light emitting diode display device, the organic light emitting diode display device including a timing controller, a driving transistor and an organic light emitting diode, the method comprising:

determining by the timing controller a predetermined driving condition;

generating by the timing controller a control signal for blocking current supplied from the driving transistor to the organic light emitting diode, so that the driving transistor does not affect the organic light emitting diode until an internal terminal of a pixel of a display panel of the organic light emitting diode display device is stabilized;

supplying by the timing controller the control signal to an emission control driver; and performing control by the emission control driver, so that an emission switching transistor disposed between the driving transistor and the organic light emitting diode is turned off, wherein the determining by the timing controller the predetermined driving condition is performed when an impedance of the organic light emitting diode is measured.

11. An organic light emitting diode display device comprising the gate driver according to claim 5, wherein the gate driver further comprises a level shifter, and the organic light emitting diode display device further comprises the power control circuit and a timing controller, and wherein the level shifter receives a voltage level control signal from the timing controller, the voltage level control signal changing a reference voltage of the emission control driver so that, the emission control driver outputs a logic high signal.

12. The organic light emitting diode display device according to claim 11, wherein the level shifter is configured to receive a high voltage signal and a low voltage signal from the power control circuit, amplify the voltage levels thereof, and supply operation power to the emission control driver.

13. An organic light emitting diode display device comprising the gate driver according to claim 7, wherein the gate driver further comprises a level shifter, and the organic light emitting diode display device further comprises the power control circuit and a timing controller, and wherein the level shifter receives a voltage level control signal from the timing controller, the voltage level control signal changing a reference voltage of the emission control driver so that the emission control driver outputs a logic high signal.

14. The organic light emitting diode display device according to claim 13, wherein the level shifter is configured to receive a high voltage signal and a low voltage signal from the power control circuit, amplify the voltage levels thereof, and supply operation power to the emission control driver.

* * * * *